United States Patent [19]

Koide

[11] 4,156,346

[45] May 29, 1979

[54] APPARATUS FOR CONTROLLING SECONDARY AIR

[75] Inventor: Toshikazu Koide, Susono, Japan

[73] Assignee: Toyota Jidosha Kogyo Kabushiki Kaisha, Aichi, Japan

[21] Appl. No.: 845,140

[22] Filed: Oct. 25, 1977

[30] Foreign Application Priority Data

Jul. 23, 1977 [JP] Japan ..... 52/87886

[51] Int. Cl.[2] ..... F01N 3/10

[52] U.S. Cl. ..... 60/290; 60/301; 60/306

[58] Field of Search ..... 60/301, 306, 290, 289

[56] References Cited

U.S. PATENT DOCUMENTS

| | | | |
|---|---|---|---|
| 3,757,521 | 9/1973 | Tourtellotte | 60/301 |
| 3,869,858 | 3/1975 | Goto | 60/306 |
| 3,888,080 | 6/1975 | Nohira | 60/290 |
| 3,906,723 | 9/1975 | Matumoto | 60/306 |
| 3,921,396 | 11/1975 | Nohira | 60/306 |
| 3,943,709 | 3/1976 | Holt | 60/301 |
| 4,070,830 | 1/1978 | Beiswenger | 60/306 |

*Primary Examiner*—Douglas Hart

*Attorney, Agent, or Firm*—Stevens, Davis, Miller & Mosher

[57] ABSTRACT

Disclosed is an apparatus for controlling secondary air for purifying exhaust gas discharged from an internal combustion engine. The apparatus comprises a pair of catalytic converters disposed in series within an exhaust system, a secondary air switching device communicated with two positions each of which is located respectively upstream of each of the catalytic converters, an actuating device for selectively communicating the secondary air switching device with each of the above-mentioned two positions, and a detecting device for detecting the temperature of the first catalytic converter located upstream of the second converter.

If the detecting device detects a condition wherein the temperature of the first catalytic converter is lower than a predetermined level, secondary air is supplied to the position upstream of the first catalytic converter. On the other hand, if the detecting device has detected a condition wherein the temperature of the first catalytic converter is above the predetermined level, secondary air is alternately supplied to each of the above-mentioned two positions. By utilizing the apparatus of the present invention, the converting efficiency of the first catalytic converter can be maintained at a high level.

9 Claims, 4 Drawing Figures

APPARATUS FOR CONTROLLING SECONDARY AIR

BRIEF DESCRIPTION OF THE INVENTION

This invention relates to an apparatus for controlling secondary air for purifying exhaust gas discharged from an internal combustion engine, and especially relates to an apparatus for controlling secondary air utilized in a system for purifying exhaust gas discharged from an internal combustion engine, which system comprises a first catalytic converter and a second catalytic converter both disposed in series within the exhaust system, and a secondary air switching means communicated with a first position and a second position each of which is situated upstream of each of the above-mentioned catalytic converters.

BACKGROUND OF THE INVENTION

Well known in the art are internal combustion engines with exhaust systems each of which is provided with a catalytic converter for purifying harmful contaminants, such as hydrocarbons (HC), carbon monoxide (CO) and nitrogen oxides ($NO_x$) contained in the exhaust gas. According to this well-known exhaust system, secondary air is supplied to a position upstream of the catalytic converter for controlling the secondary air fuel ratio at the stoichiometric air fuel ratio so as to maintain the converting efficiency of the catalytic converter at a high level. (The term "secondary air fuel ratio" used herein, is defined as the total amount of air, including secondary air, supplied to the intake system of the engine and supplied to a position between the cylinders of the engine and the entrance of the catalytic converter, to the total amount of fuel.)

The above-mentioned converting efficiency depends on the activating temperature of the catalytic converter as well as the above-mentioned secondary air fuel ratio. As a result, it is necessary to increase the temperature of the catalytic converter to the predetermined high temperature immediately after the engine is started. On the other hand, when the temperature of the catalytic converter is increased to a temperature which is too high, the converting efficiency of the catalytic converter may be decreased and the vessel which contains the catalyzer may be thermally damaged. Some attempts have been made to facilitate the warming of the catalytic converter when the engine is cold and to eliminate thermal damage of the catalytic converter after the engine has warmed up, by using two catalytic converters disposed in series within the exhaust system of an engine. By utilizing this apparatus when the engine is cold, secondary air is supplied to an exhaust port or to a position adjacent to the exhaust manifold of the engine, which exhaust port or position is located upstream of the first catalytic converter, for facilitating the conversion of exhaust gas by the first catalytic converter and for increasing the temperature of the first catalytic converter to a predetermined level. However, if secondary air is continued to be supplied after the temperature of the first catalytic converter has reached a predetermined level, the first catalytic converter may be thermally damaged by heat generated by the converting reaction of the first catalytic converter and by hot exhaust gas. Accordingly, in the conventional apparatus, secondary air is stopped from being supplied to the first catalytic converter after the temperature of the first catalytic converter has reached a predetermined level so as to prevent the first catalytic converter from thermal damage.

However, as mentioned above, in the conventional apparatus, after the temperature of the first catalytic converter has reached a predetermined level, no secondary air is supplied to the first catalytic converter for preventing the occurrence of thermal damage in the first catalytic converter. As a result, the air in the first catalytic converter becomes insufficient for producing the desirable converting efficiency of the first catalytic converter. In other words, the converting efficiency of the first catalytic converter is not utilized sufficiently.

SUMMARY OF THE INVENTION

The principal object of the present invention is to provide an apparatus for controlling secondary air in order to eliminate the above-mentioned defects. By utilizing this apparatus, the catalytic converters can be rapidly warmed within a short time. In addition, the first catalytic converter can be prevented from thermal damage.

Another object of the present invention is to provide an apparatus, by which, after the temperature of the first catalytic converter has reached a predetermined temperature, secondary air is alternately supplied to positions each of which is respectively located upstream of the first and the second catalytic converters.

The above-mentioned objects, as well as novel features of the present invention, will become more fully apparent from the detailed description of the invention set forth below with reference to the accompanying drawings. It is to be understood, however, that the drawings are only for the purpose of illustration and are not intended to be a definition of the limits of the invention.

DETAILED DESCRIPTION OF THE INVENTION

Figure 1:
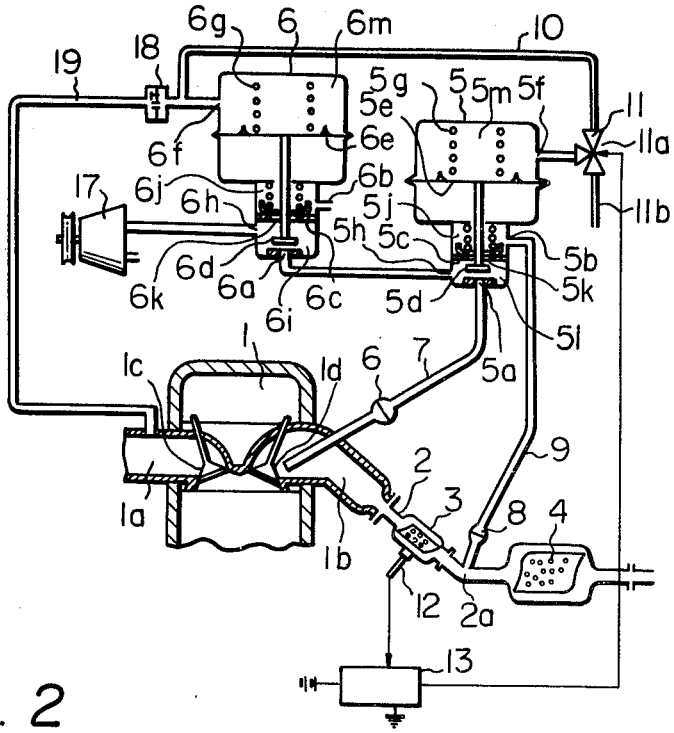
FIG. 1 is a schematic elevational view of an apparatus according to the present invention.

An apparatus according to the present invention is explained hereinafter with reference to the accompanying drawing. Referring to FIG. 1, which schematically illustrates an apparatus according to the present invention, an engine 1 is provided with an intake manifold 1*a*, an exhaust manifold 1*b*, intake valves 1*c*, exhaust valves 1*d* and pistons (not shown). A first catalytic converter 3 and a second catalytic converter 4 are disposed in series within an exhaust system 2 connected to the exhaust manifold 1*b*. Both the first catalytic converter and the second catalytic converter can include the same kind of catalyzer. In other words, both catalytic converters can include an oxidizing catalyzer for converting CO, HC, a deoxidizing catalyzer for converting $NO_x$ or a three-way catalyzer for converting CO, HC and $NO_x$. The exhaust manifold 1*b* or exhaust ports (not shown) located upstream of the first catalytic converter 3 are communicated with a lower port 5a of a secondary air switching device 5 via a first pipe 7 for supplying secondary air, which pipe 7 includes a check valve 6 for preventing a reverse flow from occurring. An intermediate portion 2a located between the first catalytic converter 3 and the second catalytic converter 4 is communicated with an upper port 5b of the secondary air switching device 5 via a second pipe 9 for supplying secondary air, which pipe 9 includes a check valve 8 for preventing a reverse flow from occurring. The secondary air switching device 5 comprises a lower chamber 5i which is provided with the lower port 5a, an upper chamber 5j provided with the upper port 5b, a partition 5c for separating the lower chamber 5i a from the upper chamber 5j, which partition 5c is provided with a valve seat 5k, and a valve 5d movable between the valve seat 5k and the lower port 5a. The valve 5d is connected to a diaphragm 5e which forms a working chamber 5m. The working chamber 5m includes a spring 5g for urging the diaphragm 5e downward. The working chamber 5m is also provided with a vacuum port 5f. When vacuum is supplied through the vacuum port 5f into the working chamber 5m, the valve 5d is displaced vertically by means of the vacuum and the spring 5g. Then secondary air supplied through a supply port 5h formed on the lower chamber 5i is selectively supplied to one of the first pipe 7 and to the second pipe 9 through the lower port 5a or through the upper port 5b. The supply port 5h is communicated with a lower port 6a of an additional secondary air switching device 6. The additional secondary air switching device 6 has a construction similar to that of the secondary air switching device 5. Therefore, the parts of the device 6 which are the same as those of the secondary air switching device 5 are designated with the same respective alphabet letters following the reference numeral 6, and further explanation for device 6 is omitted from this text. The air supply port 6h of the secondary air switching device 6 is communicated with an air pump 17, and the upper port 6b is opened to the atmosphere. A vacuum port 6f is communicated with the intake manifold 1a via a throttling device 18 and a vacuum pipe 19. The vacuum pipe 19 is communicated with the vacuum port 5f of the secondary air switching device via a second vacuum pipe 10 branched from the vacuum pipe 19 and a vacuum port 11a of an actuating valve device 11. Another port 11b of the actuating valve device 11 is opened to the atmosphere.

Figure 2:
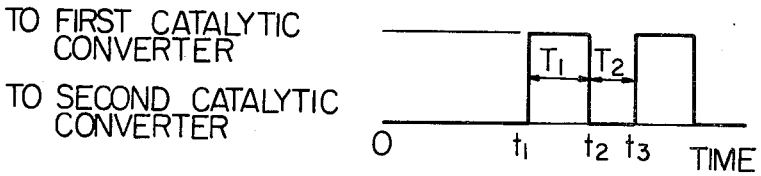
FIG. 2 is an operational diagram which shows the relationship between time and secondary air supplied to the first and second catalytic converters.
Figure 3:
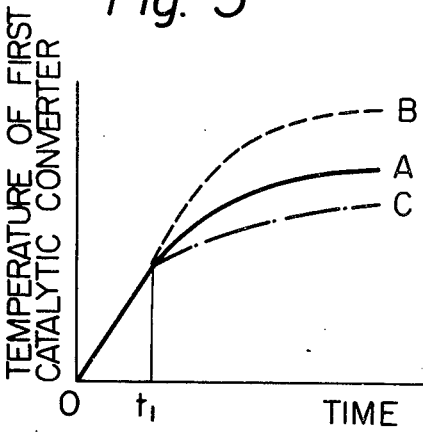
FIG. 3 is a diagram which shows the relationship between time and the temperature of the first catalytic converter.

The first catalytic converter 3 is provided with a temperature detecting device 12 which is communicated with a computer 13 so that after the detecting device 12 detects the condition wherein the temperature of the first catalytic converter has reached a predetermined level, the computer 13 transmits an alternating signal having a predetermined interval. Thereafter, the actuating valve device 11 alternatingly communicates the vacuum port 5f with one of the vacuum port 11a and the other port 11b opened to the atmosphere. The operation of the present invention is explained hereinbelow. After the engine has been started and the engine 1 is still cold, a high vacuum pressure generated in the intake manifold 1a is supplied to a working chamber 6m of the additional secondary air switching device 6. Then the valve 6d is displaced upward with the diaphragm 6e thereby causing the secondary air to be supplied from the additional secondary air switching device 6 to the supply port 5h of the secondary air switching device 5. On the other hand, the valve 5d of the secondary air switching device 5 is displaced upward by means of the vacuum pressure supplied from the second vacuum pipe 10 via the actuating valve device 11. As a result, the secondary air supplied from the supply port 5h is supplied to the exhaust manifold 1b located upstream of the first catalytic converter 3 (In FIG. 2: time 0 to $t_1$). The secondary air facilitates the conversion of the first catalytic converter 3 and rapidly increases the temperature of the first catalytic converter 3 within a short time (See FIG. 3: time 0 to $t_1$). When the temperature of the first catalytic converter 3 reaches a predetermined level (for example, 300° C.), the detecting device 12 detects this condition and transmits a signal to the computer 13. After the computer 13 has received the signal, it transmits an alternating pulse signal having a predetermined interval to the actuating valve device 11. In accordance with the pulse signal, the actuating valve device 11 communicates the vacuum port 5f with the atmosphere for an internal $T_1$, then the valve 5d is lowered and the secondary air is supplied to the intermediate portion 2a located upstream of the second catalytic converter 4 (See FIG. 2: time $t_1$ to $t_2$). After time $T_1$ has lapsed, the vacuum port 5f is communicated with the vacuum pressure again during the succeeding time $T_2$ (See FIG. 2: $t_2$ to $t_3$). The same operation is repeated hereinafter.

In the apparatus shown in FIG. 1 when the engine is being driven under heavy load conditions, since the additional secondary air switching device 6 is communicated with the intake manifold 1a of the engine 1, the valve 6d is lowered and the secondary air supplied from the air pump 17 is discharged into the atmosphere. The computer 13 is designed so that it can transmit a suitable pulse signal having intervals $T_1$ and $T_2$ in accordance with the rotating speed of the engine 1, the temperature of the cooling water, the air-fuel ratio and so on.

Figure 4:
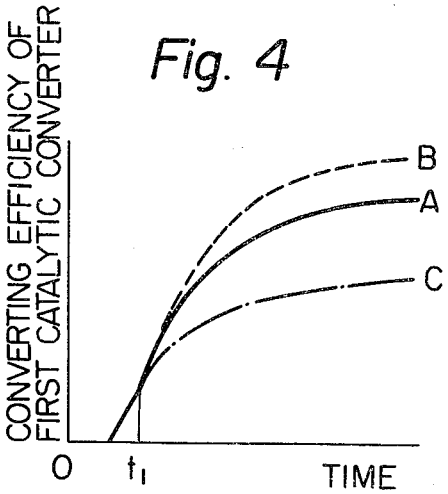
FIG. 4 is a diagram which shows the relationship between time and the converting efficiency of the first catalytic converter.

As mentioned above, the apparatus according to the present invention supplies secondary air to a position upstream of the first catalytic converter 3 while the engine 1 is still in a cold state. As a result, the temperature of the first catalytic converter is rapidly raised, as shown by the solid line A in FIG. 3 (time 0 to $t_1$). After the temperature of the first catalytic converter 3 has reached the predetermined level, the secondary air is alternately supplied to the positions each of which is located upstream of each of the first and the second catalytic converters, respectively. If the secondary air is continued to be supplied to the position upstream of the first catalytic converter, the first catalytic converter is overheated as shown by the broken line B in FIG. 3. On the other hand, the apparatus according to the present invention can prevent the first catalytic converter from overheating and thermal damage. The converting efficiency of the apparatus according to the present invention (solid line A in FIG. 4) is slightly lower than the converting efficiency shown by the broken line B (FIG. 4), which is efficiency is obtained when the secondary air is continued to be supplied to the position located upstream of the first catalytic converter 3. However, the converting efficiency shown by the solid line A (FIG. 4) is much higher than the converting efficiency shown by the dot-dash line C (FIG. 4), which efficiency is obtained when the secondary air is continuously supplied to the position upstream of the second catalytic converter 4 after the temperature of the first catalytic converter 3 has reached a predetermined level. The phenomenon, of the low converting efficiency as shown by the dot-dash line C in FIG. 4 is caused by the low temperature of the first catalytic converter 3 as shown by the dot-dash line C in FIG. 3.

In the apparatus according to the present invention, the catalytic converter can be warmed up within a short time. In addition, the first catalytic converter is free from thermal damage and can be maintained at a high temperature when the converting efficiency is high. Furthermore, in the apparatus according to the present invention, the secondary air switching device is controlled in accordance with a signal transmitted after the temperature of the first catalytic converter has reached a predetermined level. Accordingly, the apparatus, including the secondary air switching device, can follow the changes in the operation characteristics of the first catalytic converter.

What we claim is:

1. An apparatus for purifying exhaust gas discharged from an internal combustion engine, said apparatus comprising a first catalytic converter and a second catalytic converter disposed in series in an exhaust system of said engine, and a secondary air switching means communicated with a first position and a second position each of which is located upstream of each of said catalytic converters, wherein said apparatus further comprises:

a means for detecting the temperature of said first catalytic converter; and a means for actuating said secondary air switching means, said actuating means actuating said secondary air switching means so as to supply secondary air to said first position when said detecting means detects the condition wherein the temperature of said first catalytic converter is lower than a predetermined level, and said actuating means alternately actuating said secondary air switching means so as to alternately supply secondary air to said first position and said second position when said detecting means detects the condition wherein the temperature of said first catalytic converted has reached said predetermined level.

2. An apparatus for purifying exhaust gas according to claim 1, wherein said apparatus further comprises a power supply means, connected to said engine, for supplying power to said switching means.

3. An apparatus for purifying exhaust gas according to claim 2, wherein said actuating means includes a by-pass valve, said by-pass valve being communicated with said power supply means, atmosphere, and said air switching means for selectively supplying power from said power supply means or atmosphere to said air switching means in accordance with a control signal transmitted from said detecting means.

4. An apparatus for purifying exhaust gas according to claim 1, wherein said apparatus further comprises a secondary air supply means communicated with said switching means for supplying secondary air to said air switching means.

5. An apparatus for purifying exhaust gas according to claim 1, wherein said apparatus further comprises:

a power supply means connected to said engine and communicated with said air switching means via said actuating means; and a secondary air supply means communicated with said air switching means for supplying secondary air to said air switching means, whereby power supplied from said power supply means to said air switching means is controlled by said actuating means in accordance with a control signal transmitted from said detecting means so that secondary air supplied from said secondary air supply means to said switching means is selectively transferred to said first position or to said second position.

6. An apparatus for purifying exhaust gas according to claim 5, wherein said power supply means is an intake passage of said engine for supplying an intake vacuum.

7. An apparatus for purifying exhaust gas according to claim 5, wherein said secondary air supply means is an air pump connected to said engine.

8. An apparatus for purifying exhaust gas according to claim 5, wherein said apparatus further comprises an additional air switching means disposed at a position between said secondary air supply means and said air switching means, said additional air switching means is connected to said power supply means, whereby when said engine has reached a predetermined range in which said power supply means can decrease the power supply, said additional air switching means stops the supply of secondary air to any of said first and second positions.

9. An apparatus for purifying exhaust gas according to claim 1, wherein said actuating means includes a by-pass valve and said purifying apparatus further comprises:

an intake passage of said engine communicated with said air switching means via said by-pass valve for supplying an intake vacuum; and an air pump mounted on said engine and communicated with said air switching means for supplying secondary air to said air switching means, whereby said intake vacuum supplied from said intake passage is supplied to said air switching means or is stopped from being supplied to said means by said by-pass valve in accordance with a control signal transmitted from said detecting means so that secondary air supplied from said air pump is selectively supplied to said first position or to said second position.

* * * * *